US007559115B2

(12) United States Patent
Tong et al.

(10) Patent No.: US 7,559,115 B2
(45) Date of Patent: Jul. 14, 2009

(54) RETRACTABLE LUGGAGE PULL ROD WITH ROTATING HOOK

(76) Inventors: Joy Tong, 2932 NW. 27$^{th}$ St. Bldg. 14, Ft. Lauderdale, FL (US) 33311; Van Himbeeck Clemens R.J.J., St-Sauveurstraat 140 9600, Ronse (BE)

( * ) Notice: Subject to any disclaimer, the term of this patent is extended or adjusted under 35 U.S.C. 154(b) by 246 days.

(21) Appl. No.: 11/650,928

(22) Filed: Jan. 9, 2007

(65) Prior Publication Data

US 2008/0163456 A1 Jul. 10, 2008

(51) Int. Cl.
*A47B 95/02* (2006.01)

(52) U.S. Cl. ..... 16/113.1; 16/429; 16/DIG. 41

(58) Field of Classification Search ..... 16/113.1, 16/429, DIG. 41; 190/18, 115, 102, 108; 280/655, 47.36, 47.371
See application file for complete search history.

(56) References Cited

U.S. PATENT DOCUMENTS 4,759,431 A * 7/1988 King et al. ..... 190/108
5,829,559 A * 11/1998 Nordstrom et al. ..... 190/108
6,082,757 A * 7/2000 Lin ..... 16/429
6,938,741 B2 * 9/2005 Hsien et al. ..... 190/108

FOREIGN PATENT DOCUMENTS

EP 382953 A1 * 8/1990

* cited by examiner

*Primary Examiner*—Victor Batson
*Assistant Examiner*—Jeffrey O'Brien
(74) *Attorney, Agent, or Firm*—Bacon & Thomas, PLLC

(57) ABSTRACT

A retractable luggage pull rod adapted with a rotating hook includes an annular handle, a single post, and a hook disposed between the handle and the single post. The hook is concealed when not in use and rotated to be exposed when in use to hang an object thereon. Once the object is removed the hook is automatically returned to its concealed location by a coil spring.

2 Claims, 7 Drawing Sheets

RETRACTABLE LUGGAGE PULL ROD WITH ROTATING HOOK

BACKGROUND OF THE INVENTION (a) Field of the Invention

The present invention is related to a retractable luggage pull rod, and more particularly to one adapted with a rotating hook to hang an object on the hook.

(b) Description of the Prior Art

To facilitate towing, a luggage or bag of is usually adapted with multiple castors and a built in retractable carrier frame to be pulled out for handling.

SUMMARY OF THE INVENTION

The primary purpose of the present invention is to provide a retractable luggage pull rod adapted with a rotating hook. The pull rod is essentially a single post provided at a top portion thereof with an annular handle. A hook is provided between the annular handle and the single post. The hook is concealed between the annular handle and the single post but can be rotated to expose a portion thereof for hanging an object on the hook. A coil functions to return the hook to its original position.

Further, opposing sides of the luggage can have a press plates disposed thereon. Each press plate may be concealed in or exposed out of the luggage to secure the object suspended on the hook with a cord.

DETAILED DESCRIPTION OF THE PREFERRED EMBODIMENTS

Figure 1:
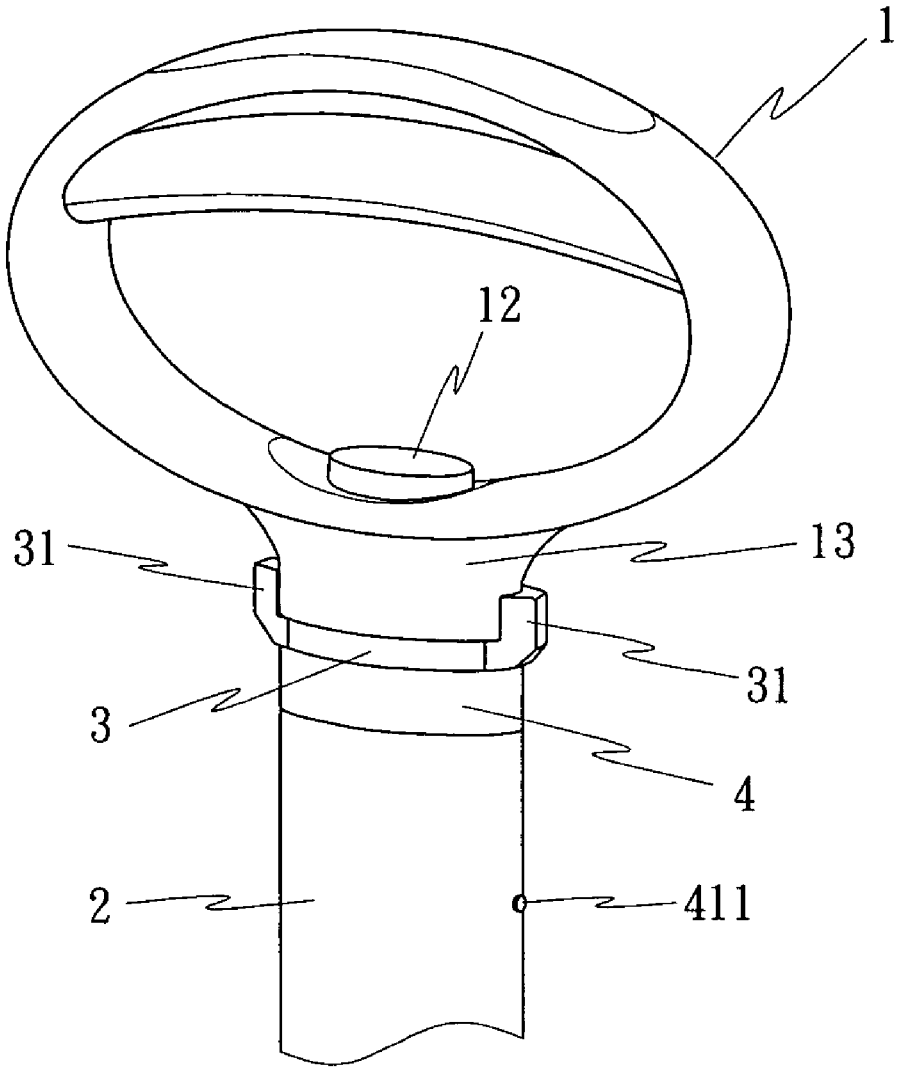
FIG. 1 is a perspective view of the present invention.
Figure 2:
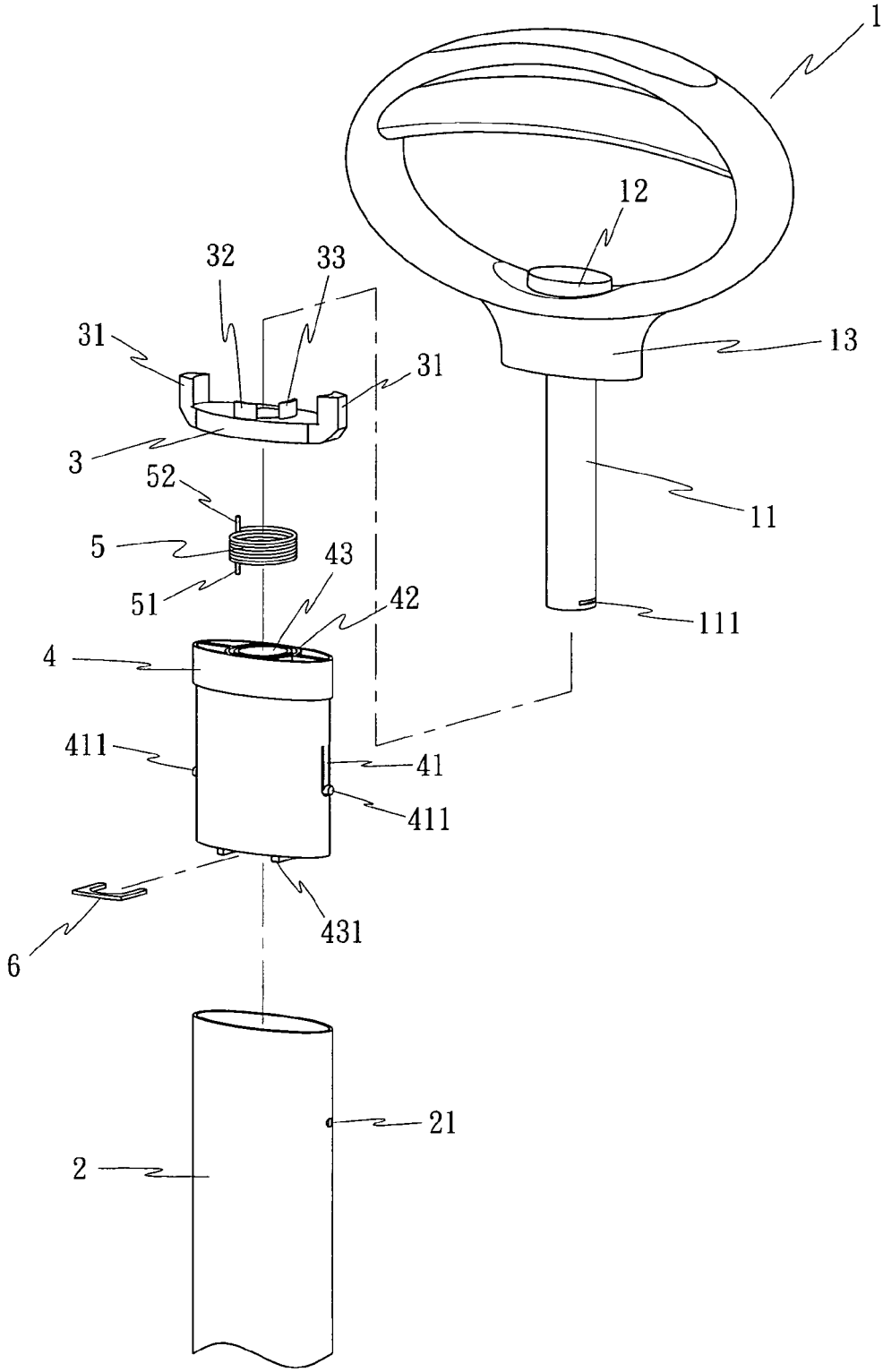
FIG. 2 is an exploded view of the present invention.
Figure 3:
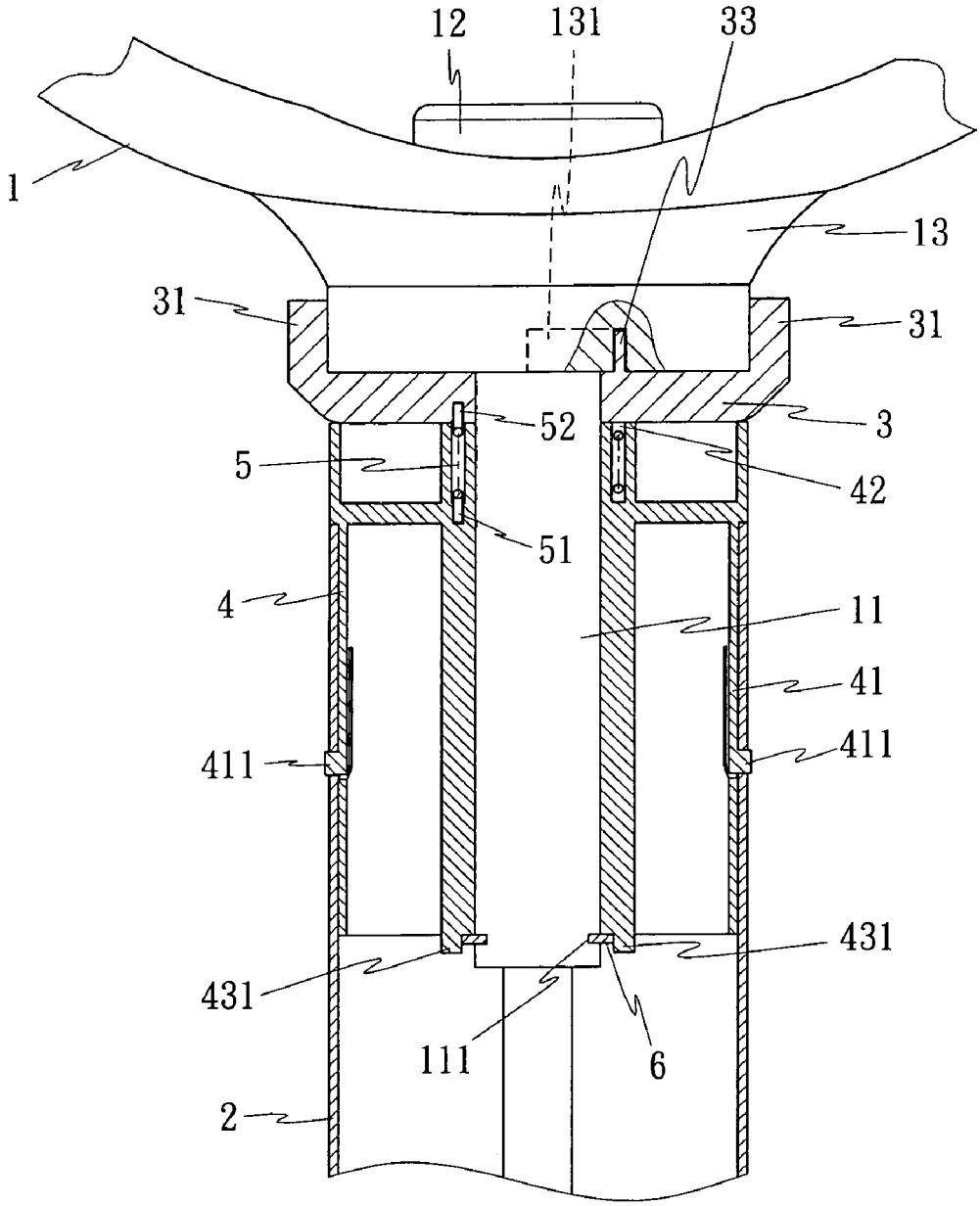
FIG. 3 is a sectional view of the present invention.
Figure 4:
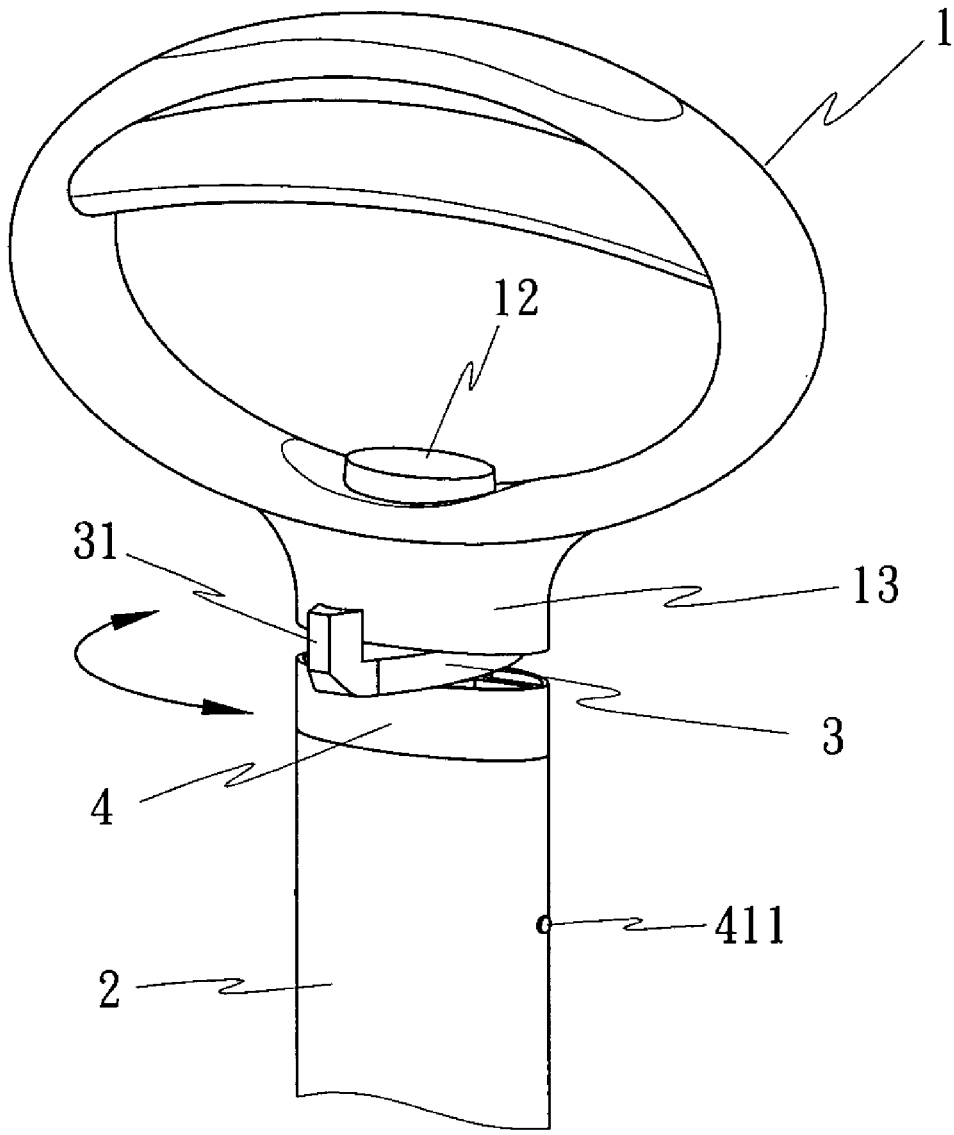
FIG. 4 is a schematic view showing movement of the present invention.

Referring to FIGS. 1, 2, and 3, a retractable luggage pull rod adapted with a rotating hook of the present invention is essentially comprised of an annular handle 1, a single post 2, and a hook 3. The single post 2 is coupled to a holder 4 and a coil 5 engages both the the hook 3 and the holder 4.

An extension post 11 extends from the lower end of the annular handle 1 and a locking slot 111 is disposed at opposing side of the lower end of the extension post 11. A press switch 12 is disposed on the annular handle to control retraction of the pull rod A throat 13 is connected to the upper end of the extension post 11 and a limit slot 131 is disposed on an end surface of the throat 13, as illustrated in FIG. 3.

The single post 2 is a non-circular post, such as an oval post, connected to the luggage as illustrated in FIGS. 4-7.

The hook 3 has an annular shape corresponding to that of the single post 2, and the extension post 11 passes through a hole in the hook. A hooking portion 31 is disposed on opposing sides of the hook 3. Alternatively, the hook portion 31 is can be disposed on only one side of hook 3. Two retainers 32.

33 are disposed on the end surface of the hook 3. The retainers 32, 33 engage to limit slots 131 such that the hook 3 can freely rotate within a range of angles limited by the limit slot 131.

The holder 4 is made in a shape corresponding to that of the single post 2 and has two mobile elastic plates 41 provided on opposing sidewalls of the holder 4. Protruding portions 41 are located on each of the elastic plate 41 for engaging respective holes 21 formed in the single post 2 when the holder 4 is inserted into the single post 2. A recessed portion 42 and an annular tube 43 are formed on a top portion of the holder 4 and an extension tube 431 extends from a lower end of the holder 4.

The torque coil 5 is secured in the recessed portion 42 of the holder 4 with one end 51 locked to the holder 4 and another end 52 locked to the hook 3.

Figure 5:
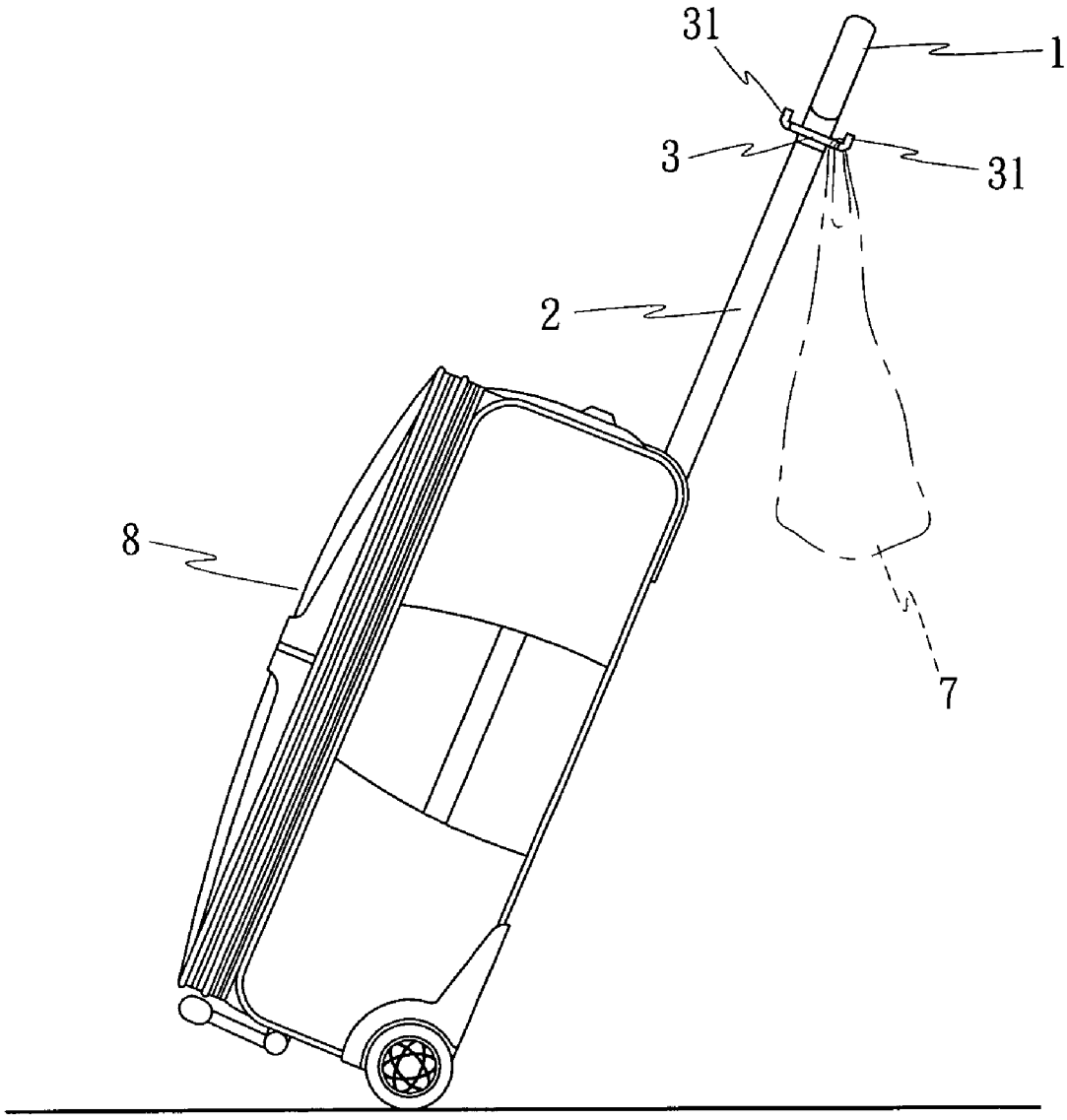
FIG. 5 is a schematic view showing an operating status of the present invention.

Accordingly, the extension post 11 of the annular handle 1 passes through the hook 3, the torque coil 5, and the annular tube 43 in sequence before passing into the extension tube 431 at the lower end of the holder 4. A locking member 6 engages the locking slot 111 to secure the extension post 11. The holder 4 is then inserted and secured in the single post 2 for the hook 3 to be concealed between the annual handle 1 and the single post 2 if the hook 3 is not needed as illustrated in FIG. 1. Alternatively, the hook 3 can be rotated to expose the hook 3 for hanging an object 7 thereon as illustrated in FIG. 5. Once the object 7 is removed from the hook 3, the hook 3 will automatically return due to the torque coil 5 as illustrated in FIG. 1.

Figure 6:
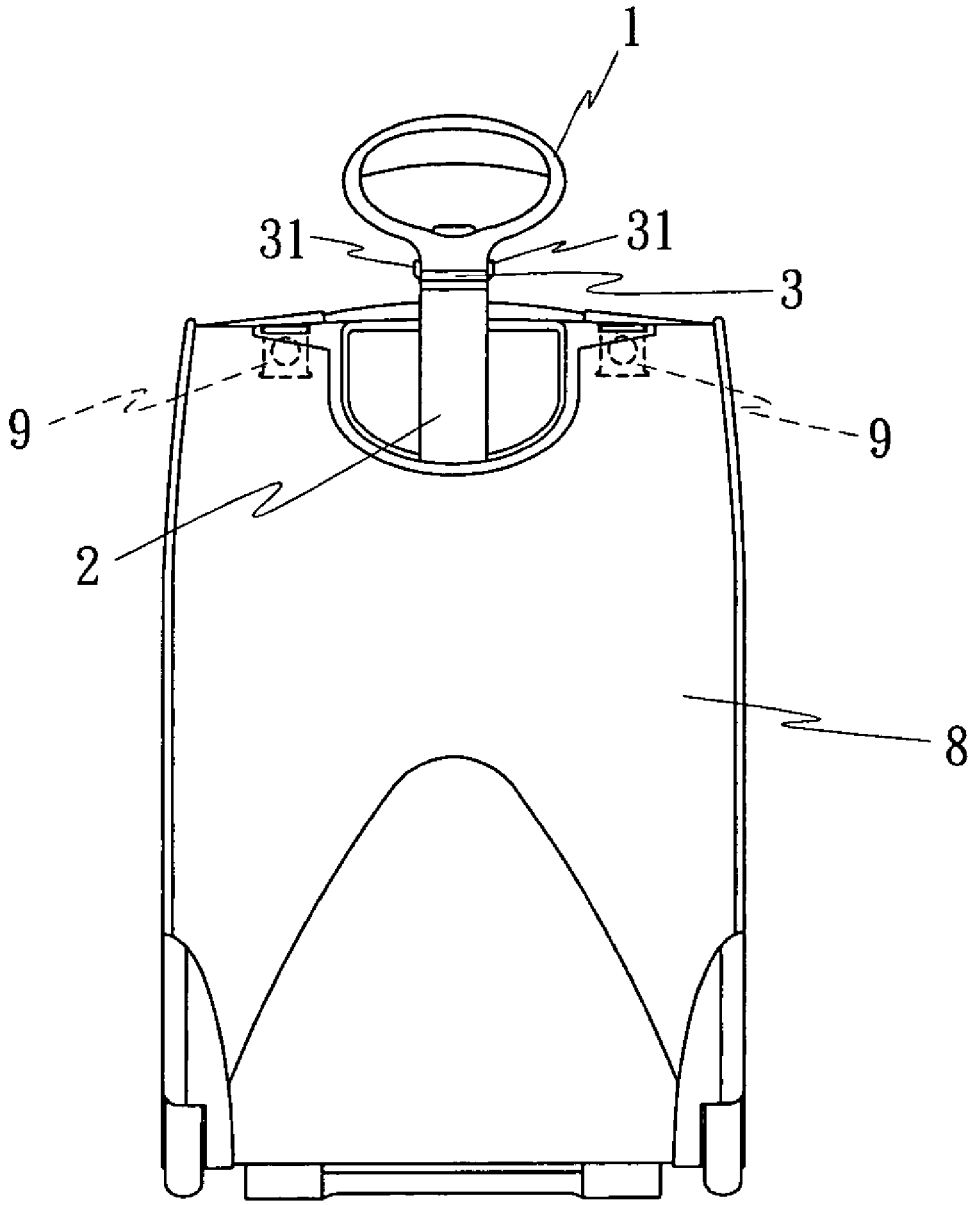
FIG. 6 is a schematic view showing a preferred embodiment of the present invention is adapted to a luggage with additional press plates.
Figure 7:
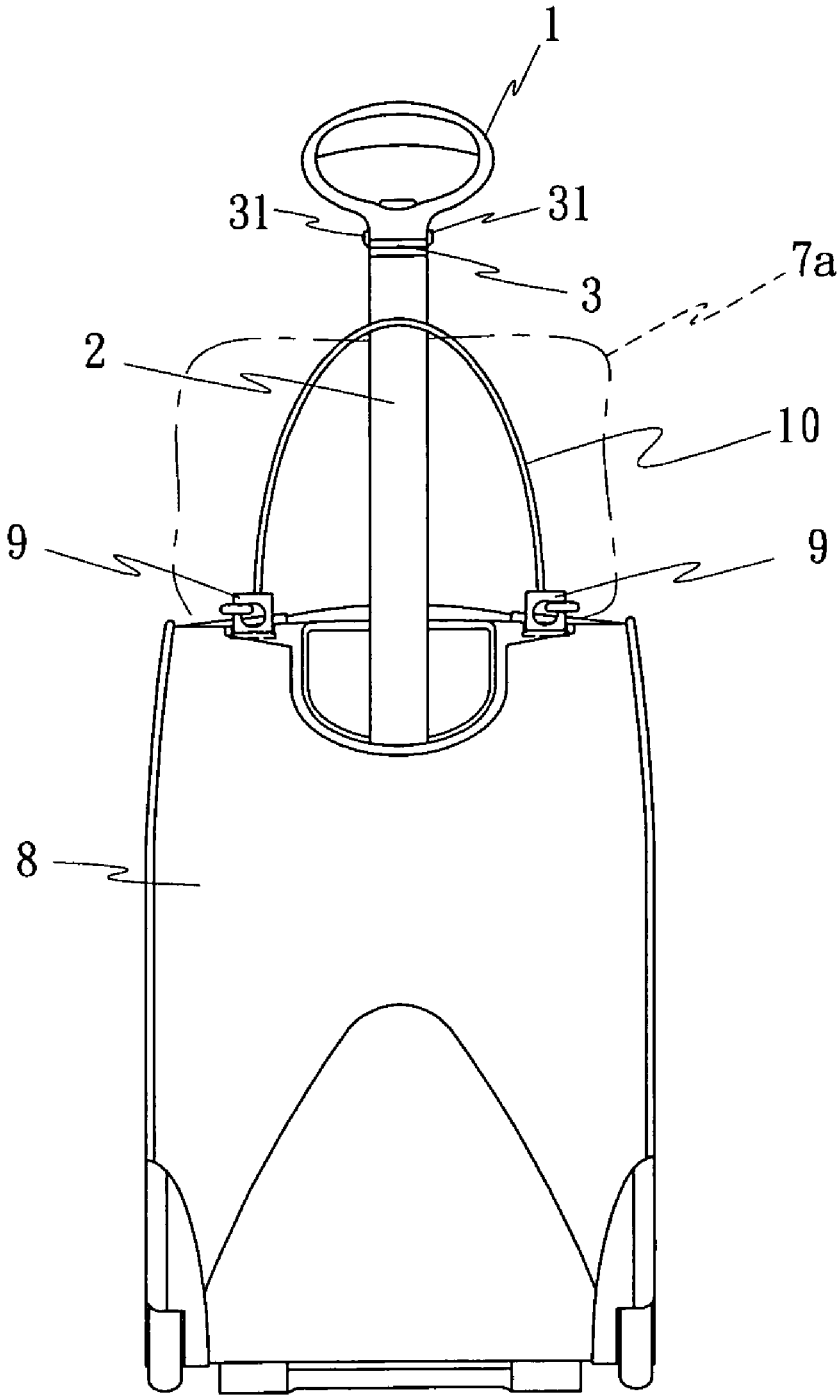
FIG. 7 is a schematic view showing an operating status of the preferred embodiment of the present invention.

Now referring to FIG. 6, opposing top side portion of a luggage piece 8 are attached with two press plates 9. The press plates 9 are retreated when not in use. The press plates 9 can be pressed causing them to extend out of the luggage 8, as illustrated in FIG. 7, where both ends of an elastic cord 10 can be tied top the press plates 9 to anchor an object 7*a* placed on the luggage.

What is claimed is:

1. A retractable luggage pull rod adapted for connection to a luggage member, comprising:

an annular handle having an extension post disposed on a lower end portion thereof, locking slots being disposed on opposing sides of the extension post, a throat member being connected to an upper end of the extension post, a limit slot being disposed on an end surface of the throat member;

a single post adapted to be attached to the luggage member and having a non-circular annular shape, at least one insertion hole formed in the single post;

a hook having an annular shape corresponding to the shape of the single post, a hooking portion being disposed on at least one side of the hook, at least one retainer being disposed on an end surface of the hook corresponding to the limit slot on the annular handle, the hook being freely rotatable within a range of angles limited by the limit slot;

a holder having an annular shape corresponding to the shape of the single post, a pair of mobile elastic members being disposed on opposing sidewalls of the holder, each mobile elastic member having a protruding portion disposed thereon corresponding to the at least one insertion hole of the single post, a recessed portion and an annular tube being disposed on an upper end portion of the holder, an extension tube extending from a lower end portion of the holder, a torque coil secured in the recessed portion of the holder such that a first end of the torque coil is coupled to the holder and a second end of the torque coil is coupled to the hook, wherein the extension post of the annual handle passes through the hook, the torque coil and the annual tube in sequence, the holder is configured for insertion into the single post, and a locking member engages the locking slot of the extension post to secure the extension post.

2. The retractable luggage pull rod of claim 1, wherein a pair of press plates are configured for attachment to opposing top side portions of the luggage member for securing an object placed on the luggage member, and the press plates are movable between an anchor position in which the press plates protrude from the luggage member and a non-anchor position in which the press plates are recessed into the luggage member.

* * * * *